US005699590A

United States Patent [19]

Erard et al.

[11] Patent Number: 5,699,590

[45] Date of Patent: Dec. 23, 1997

[54] CLASP WITH UNFOLDING BUCKLE

[75] Inventors: Francis Albert Erard, La Chaux-de-Fonds; Michel Paul Ratajski, Bienne, both of Switzerland

[73] Assignee: Grandjean S.A., La Chaux-de-Fonds, Switzerland

[21] Appl. No.: 746,777

[22] Filed: Nov. 15, 1996

[30] Foreign Application Priority Data

Nov. 21, 1995 [FR] France ..... 95 013802

[51] Int. Cl.[6] ..... A44C 5/00

[52] U.S. Cl. ..... 24/71 J; 24/69 J; 24/616; 24/265 WS

[58] Field of Search ..... 24/71 J, 70 J, 24/69 J, 68 J, 265 WS, 616

[56] References Cited

U.S. PATENT DOCUMENTS 3,706,117 12/1972 Axisa .
5,365,955 11/1994 Desgroux et al. .

FOREIGN PATENT DOCUMENTS 319461 6/1989 European Pat. Off. .
430764 6/1991 European Pat. Off. .
666165 7/1988 Switzerland .
2268217 1/1994 United Kingdom .

*Primary Examiner*—Victor N. Sakran
*Attorney, Agent, or Firm*—Sughrue, Mion, Zinn, Macpeak & Seas, PLLC

[57] ABSTRACT

The bracelet clasp is of the unfolding buckle type comprising a base (1) and two strips (2, 4) capable of folding down onto the base. A cover (10) held by a push button (12) maintains the clasp in a closed position.

The clasp comprises means (13) for the instantaneous raising of the cover (10) when pressure is exerted on the push button (12) to open the clasp.

This device avoids a notch locking device which leads to a laborious manoeuvre for opening the clasp. Incidentally, the strands (8, 9) of the bracelet are hinged onto the strips (2, 4) which allows the bracelet to be presented flat.

9 Claims, 3 Drawing Sheets

CLASP WITH UNFOLDING BUCKLE

BACKGROUND OF THE INVENTION

The present invention relates to a bracelet clasp of the unfolding buckle type comprising a base, at least one first strip capable of folding down onto the base, the base and the first strip being attached to each other by one of their ends by means of a first hinge, the other end of the first strip having means for fixing a first strand of the bracelet, a cover locking the first strip in a folded down position on the base, said cover being mounted on said base by means of a hinge so as to effect lateral rocking with respect to the longitudinal direction of the bracelet, and a push button mounted in the base to lock said cover onto said base.

A clasp answering the generic definition given hereinabove is known for example from patent documents CH-A-666 165 and EP-A-0 319 461.

Document CH-A-666 165 discloses a clasp comprising a base and a strip capable of folding down onto the base. The base and the strip are hinged to each other by a hinge-pin and are held in a closed position by a notch. In order to avoid any inadvertent opening of the clasp, a cover or bridge is fixed laterally by a second hinge-pin onto the base. The cover is able to be folded down above the strip and the strand of the bracelet which its attached thereto. Once folded down, the cover is locked by a notch.

Document EP-A-0 319 461 discloses a same type of clasp comprising a base and two folding strips. A cover is hinged onto the base and capable of folding down laterally onto the latter with respect to the longitudinal direction of the bracelet. The end of each strand is connected to a strip by a staired hinge. In the folded down position of the strips, and when the cover is folded onto the base, such cover is held notched onto such base whilst blocking a part of the staired hinge so as to prevent any inadvertent opening of the clasp.

In both cases, it will be noted that the cover is held notched onto the base. This means that in order to release it and thus to open the clasp, it is necessary to exert a digital effort on the cover. Since the designer wishes to assure proper holding of the cover, upon the sale of the product and after several years of use, he will ensure that the catch mechanism is externally resistant. This obliges the user to exert great force on the cover at the risk of hurting himself, or breaking a nail. In the case of document EP-A-0 319 461 however, a third embodiment provides a clasp fitted with a push button which can be actuated to release the cover. It is to be noted however that the pressure on the push button does not raise the cover and thus must be accompanied by a digital raising gesture, which complicates the opening manoeuvre.

SUMMARY OF THE INVENTION

In order to avoid these disadvantages, the clasp of the invention is characterised in that it requires very little effort to release the cover since it comprises means for the instantaneous raising of said cover when pressure is exerted on the push button to open the clasp.

The advantages brought by this particular arrangement according to the invention will be clear upon reading the description which follows, such description being supported, by way of example, by the drawing in which:

DESCRIPTION OF THE PREFERRED EMBODIMENT

Figure 1:
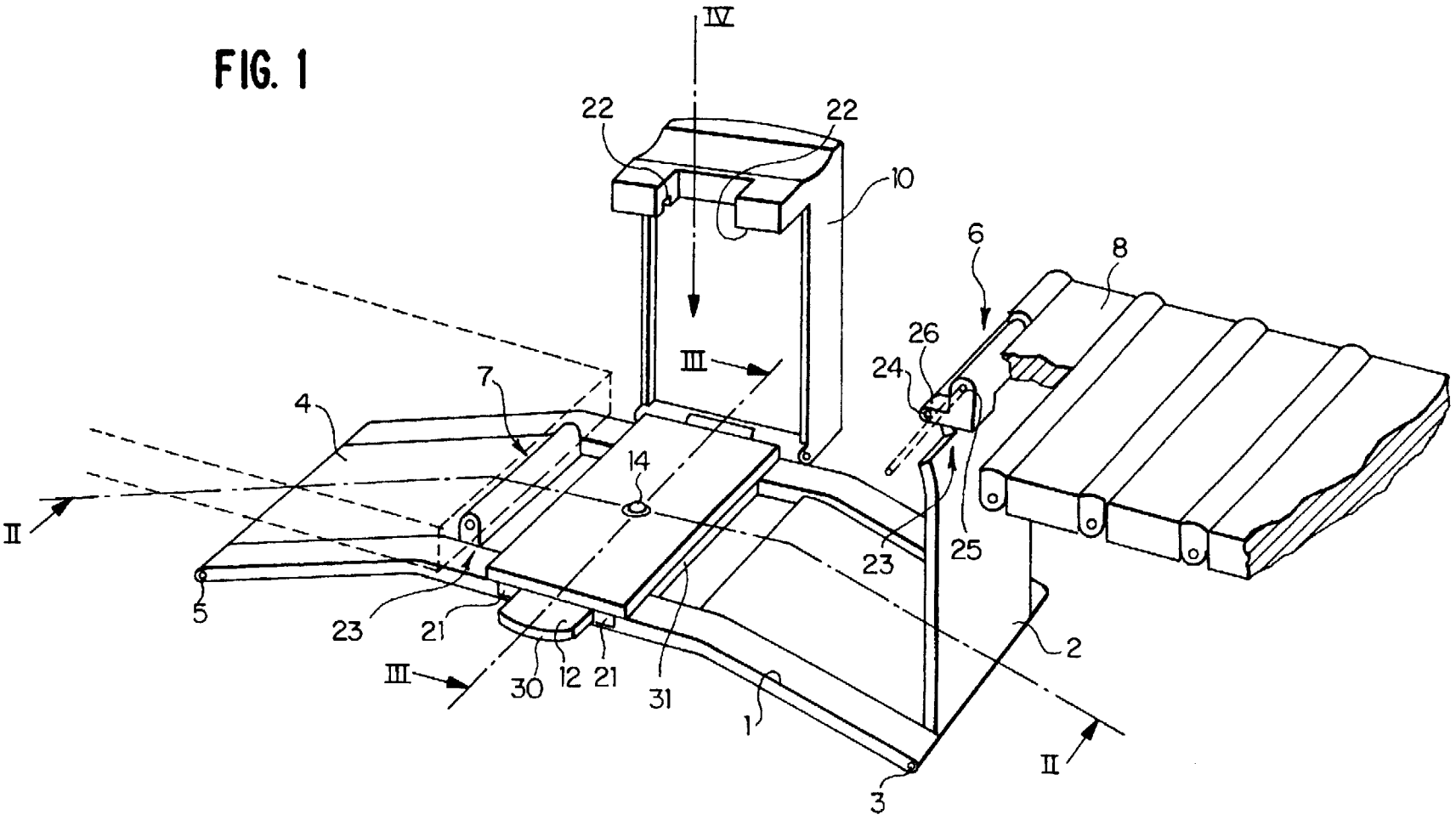
FIG. 1 is a perspective view of the clasp of the invention shown in an open position.
Figure 2:
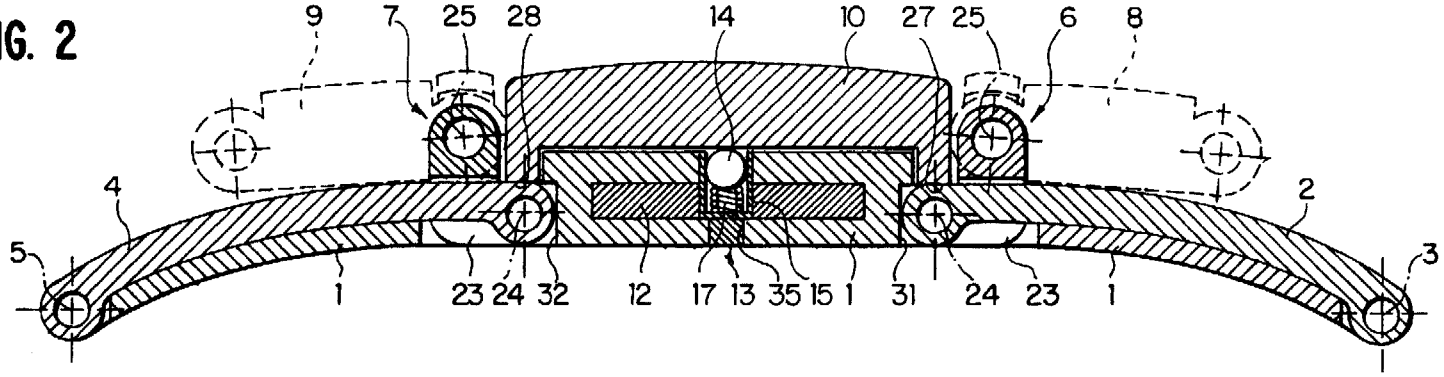
FIG. 2 is a longitudinal cross-section of the clasp along the line II—II of FIG. 1, the clasp being shown in a closed position.
Figure 4:
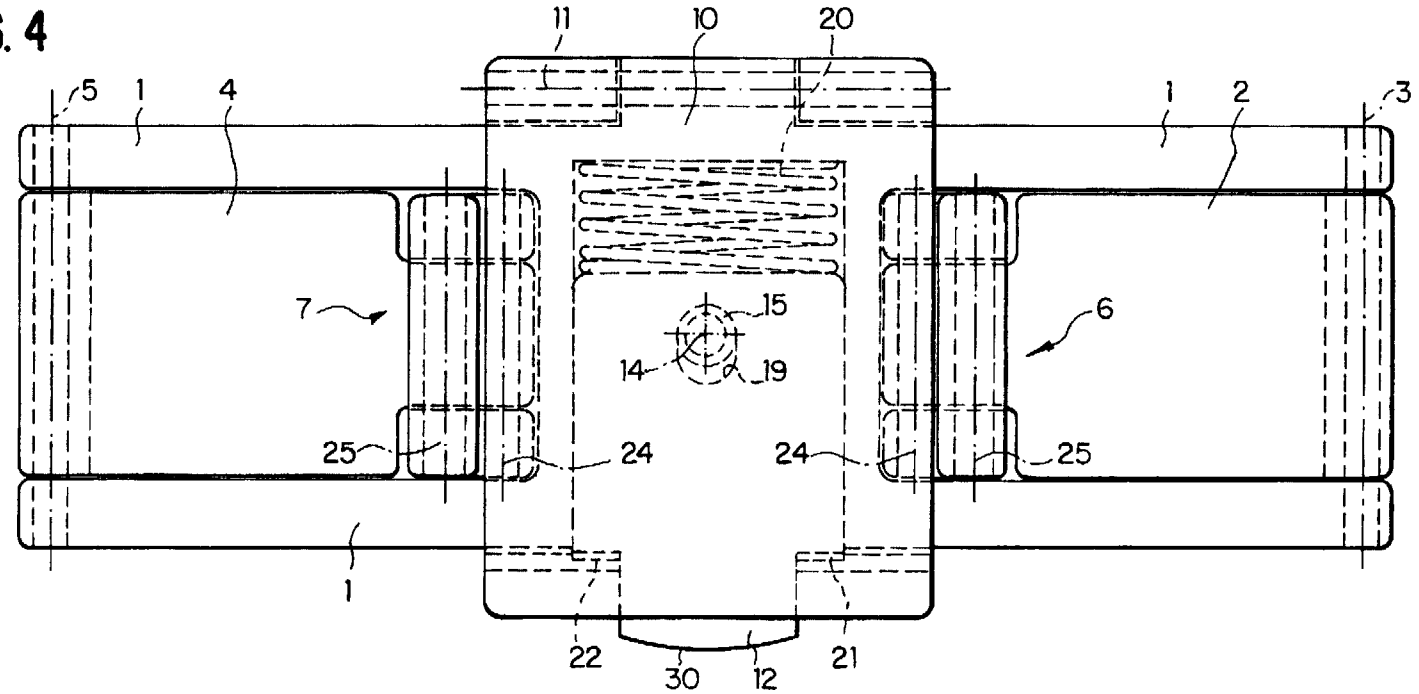
FIG. 4 is a top view of the clasp along the arrow IV of FIG. 1, the clasp being shown in a closed position.

As is seen in FIGS. 1, 2 and 4, this clasp comprises two strips folding down onto the base, but could comprise only one such strip.

In the event that this clasp comprised only a single strip, a strand of the bracelet would be directly hinged onto the base, for example to the left of the figure, while the other strand would be hinged to the end of the only existing strip, as shown to the right of the figure. Thus the invention may suit clasps comprising one or two strips, the description which will now be made thereof being based on a clasp with two strips.

Figure 3:
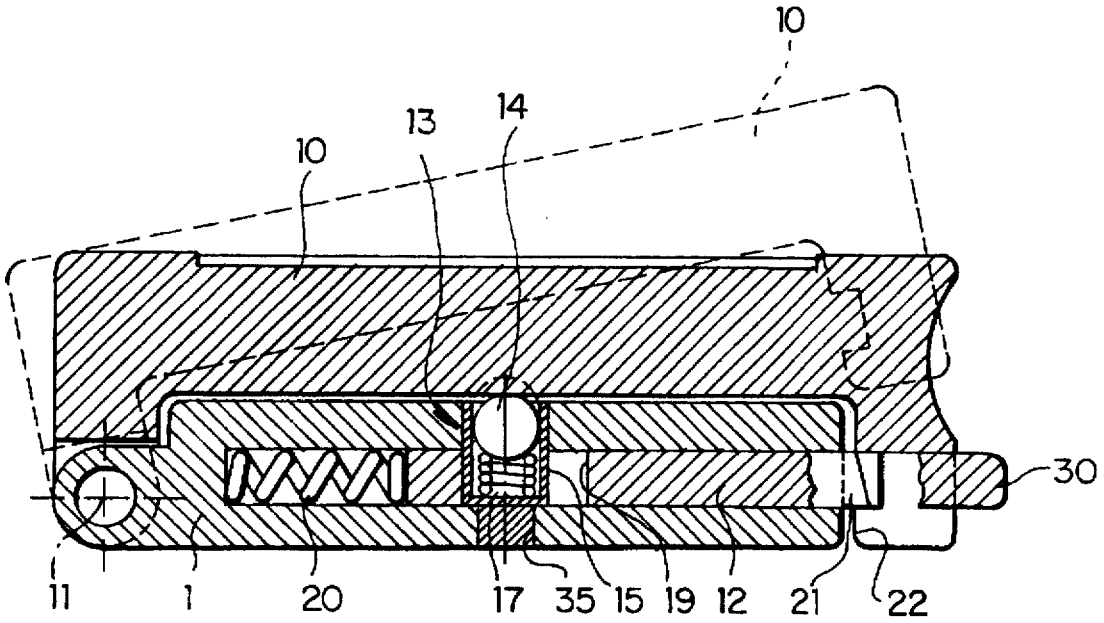
FIG. 3 is a transversal cross-section of the clasp along the line III—III of FIG. 1, the clasp being shown in a closed position.
Figure 5:
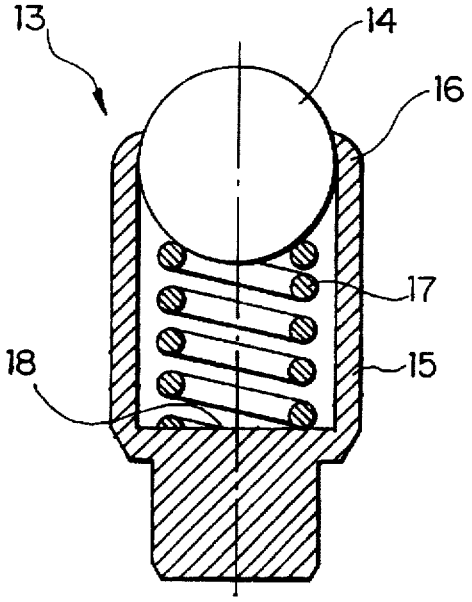
FIG. 5 shows an example of means for raising the cover shown in the preceding figures.

The clasp comprises a base 1 bent so as to be adapted to the curve of the wrist which wears it. It further comprises a first strip 2 and a second strip 4 each capable of folding down onto base 1. Base 1 and first strip 2 are attached to each other by one of their ends by means of a first hinge 3. The other end of first strip 2 has means for fixing a first strand or link 8 forming the bracelet. Likewise, base 1 and second strip 4 are attached to each other by one of their ends by means of a second hinge 5. The other end of second strip 4 has means for fixing a second strand or link 9 forming the bracelet. The clasp also comprises a cover 10 as is illustrated by FIG. 3, such cover being mounted on base 1 by means of a hinge 11 to effect a lateral rocking with respect to the longitudinal direction of the bracelet. This cover locks first and second strips 2 and 4 onto base 1, as will be explained in detail hereinbelow. The clasp also comprises a push button 12 mounted in base 1 for locking cover 10 on base 1 according to the explanations which will also be given hereinbelow.

The main characteristic of the present invention consists of providing means 13 for the instantaneous raising of cover 10 when pressure is exerted on push button 12 to open the clasp. Means 13 are shown in all the figures.

Such means can be implemented in different ways. One can generally envisage a spring loaded element mounted within base 1 and abutting under cover 10. This could be for example a simple spring leaf extending in a groove provided in the base.

FIGS. 1 to 5 show that a ball has been preferred. As is clearly shown in the detailed drawing of FIG. 5, ball 14 is mounted in a blind tube 15. The top of tube 15 comprises a setting which holds the ball against the force exerted thereon by a helical spring 17. The spring is disposed between ball 14 and bottom 18 of tube 15. When the clasp is in the closed position, the cover exerts pressure on ball 14 which presses down spring 17 as is shown in FIGS. 2 and 3. As soon as cover 10 is released (unlocked) by manually pressing on push button 12, the ball acts as an ejector of the cover which is instantaneously automatically raised upwardly from the base without the need for further manual intervention (see FIG. 3). As a result, there is no difficulty in causing the cover to rock in a totally open position as shown in FIG. 1. This rocking takes place without the necessity of manually overcoming the holding force of a notch locking system used with the clasps of the above mentioned prior art documents. Moreover, it will be understood that if the spring force is sufficiently strong, the ball will be able to completely rock open the cover without the need for the wearer to manually intervene.

As shown in FIGS. 3 and 4, tube 15 enclosing ball 14, fulfills an additional function to that of raising means. The figures show that such tube traverses an oblong hole 19 provided in push button 12. Tube 15, driven into base 1, thus acts to limit the travel of the push button, on the one hand, preventing it from coming out of base 1 and on the other hand, limiting its penetration into said base.

Push button 12 of the clasp is a plate mounted so as to slide in the base under the action of the return force of a spring 20, as shown in FIGS. 3 and 4. Opposite spring 20, such plate 12 comprises a lug 30 which emerges from the base and upon which the finger pressure is exerted. As is seen in FIGS. 1, 3 and 4, plate 12 comprises two slanting edges 21 (a single slanting edge would be sufficient). As is well illustrated in FIG. 3, when cover 10 is closed, slanting edge 21 of plate 12 hooks under notch 22 of cover 10. When pressure is exerted on lug 30 of plate 12, slanting edge 21 is released from notch 22 and cover 10 is instantly raised under the effect of the ejection force exerted by spring 17 acting on ball 14.

One sees in FIGS. 1, 2 and 4 how strands or links 8 and 9 are fixed onto corresponding strips 2 and 4. Fixing means 6 and 7 each comprise an L shaped element 23 which is well illustrated in FIG. 1. The end of the long part of L shaped element 23 comprises a first hinge pin 25 on which the strand is hinged. The end of the short part of L shaped element 23 comprises a second hinge pin 24 on which strip 2 or 4 is hinged. This double hinging allows the bracelet to be displayed flat, in a shop window or a presentation case, which was not the case of the bracelet disclosed in aforecited patent document EP-A-0 319 461, since the L shaped element disclosed in such document has a strand attachment which cannot pivot. This flat presentation requires little height space whilst it is aesthetic for displaying the bracelet to advantage.

The same FIGS. 1, 2 and 4 show finally that L shaped element 23 has a short part 26 whose upper surface is situated under one of the transversal edges 27 or 28 of cover 10, when the clasp is in a closed position. This arrangement allows the locking of strips 2 and 4. It will be noted finally that base 1 comprises notches 31 and 32 under which, respectively, the end of strips 2 and 4 click (into place), which assures a second safety device for the closing of the clasp, the first safety device being assured by cover 10.

What is claimed is:

1. A bracelet clasp of the type with an unfolding buckle comprising a base, at least one first strip capable of folding down onto the base, the base and the first strip being attached to each other by one of their ends by means of a first hinge, the other end of the first strip having means for fixing a first strand of the bracelet, a cover locking the first strip in a folded down position on the base, said cover being mounted on said base by means of a hinge so as to effect lateral rocking with respect to the longitudinal direction of the bracelet, and a push button mounted in the base to lock said cover onto said base, wherein said clasp comprises means for the instantaneous raising of said cover from said base, without manual intervention, when pressure is manually exerted on the push button to unlock the cover from said base.

2. A clasp according to claim 1, wherein the means for the instantaneous raising of the cover comprise a spring element mounted in the base, this element abutting under said cover.

3. A clasp according to claim 2, wherein said spring element comprises a ball mounted in a blind tube driven into the base, the top of the tube comprising a setting holding the ball, a return spring being placed between the ball and the bottom of the tube.

4. A clasp according to claim 3, wherein the push button of the clasp comprises an oblong hole through which the tube passes to limit the travel of said push button.

5. A clasp according to claim 1, wherein the push button is a plate mounted so as to slide in base under the action of the return force of a spring, this plate comprising means for limiting its travel and at least one slanting edge for hooking onto at least one notch of the lateral edge of the cover opposite its hinge.

6. A clasp according to claim 1, wherein the clasp comprises a second strip capable of folding down onto the base, the base and the second strip being attached to each other by one of their ends by means of a second hinge, the other end of the second strip having means for fixing a second strand of the bracelet, the cover simultaneously locking said first and second strips in a folded down position on the base.

7. A clasp according to claim 6, wherein the means for fixing a strand to the corresponding strip comprise an L shaped element, each of the ends of the L shaped element comprising means for allowing, on the one hand, the hinging of said element on said strip and on the other hand, the hinging of said element onto said strand.

8. A clasp according to claim 1, wherein the means for fixing a strand to the corresponding strip comprise an L shaped element, each of the ends of the L shaped element comprising means for allowing, on the one hand, the hinging of said element on said strip and on the other hand, the hinging of said element onto said strand.

9. A clasp according to claim 8, wherein the short part of the L shaped element is situated under a transversal edge of the cover when the clasp is in a closed position thus assuring the closing and preventing the opening of the clasp.

* * * * *